US007481300B2

(12) United States Patent
Aulanko et al.

(10) Patent No.: US 7,481,300 B2
(45) Date of Patent: Jan. 27, 2009

(54) ELEVATOR ROPING ARRANGEMENT

(75) Inventors: Esko Aulanko, Kerava (FI); Jorma Mustalahti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/785,657

(22) Filed: Apr. 19, 2007

(65) Prior Publication Data

US 2007/0227832 A1 Oct. 4, 2007

Related U.S. Application Data

(63) Continuation of application No. PCT/FI2005/000439, filed on Oct. 11, 2005.

(30) Foreign Application Priority Data

Nov. 16, 2004 (FI) ..... 20041473

(51) Int. Cl.
*B66B 11/08* (2006.01)

(52) U.S. Cl. ..... 187/266; 187/239; 187/406

(58) Field of Classification Search ..... 187/239, 187/254, 266, 406; *B66B 9/16, 11/00, 11/08, B66B 7/06, 1/00*

See application file for complete search history.

(56) References Cited

U.S. PATENT DOCUMENTS 5,429,211 A * 7/1995 Aulanko et al. ..... 187/254
2002/0139619 A1* 10/2002 Qiu et al. ..... 187/239
2002/0185338 A1* 12/2002 Bauer ..... 187/266
2003/0159891 A1 8/2003 Ach et al.
2004/0035645 A1* 2/2004 Orrmann ..... 187/266
2004/0168861 A1* 9/2004 Abe ..... 187/277

FOREIGN PATENT DOCUMENTS

JP 6263369 9/1994
WO WO 2003064309 A1 * 8/2003

OTHER PUBLICATIONS

International Search Report (PCT/ISA/210), (PCT/ISA/220).

* cited by examiner

*Primary Examiner*—Peter M Cuomo
*Assistant Examiner*—Stefan Kruer
(74) *Attorney, Agent, or Firm*—Harness, Dickey & Pierce, P.L.C.

(57) ABSTRACT

An elevator roping arrangement includes: hoisting ropes; diverting pulleys; and a fixing and support arrangement. First and fourth diverting pulleys are disposed on the elevator car, while second and third diverting pulleys are disposed in an upper part of an elevator shaft. The hoisting ropes pass from a traction sheave to the diverting pulleys. The fixing and support arrangement is disposed at a top end of elevator car guide rails and includes two support beams. Each support beam is fixed at a first end to a wall of the shaft, extends from the first end to a second end away from the wall, and is fixed to a guide rail between the ends. A vertical plane is defined between the guide rails. At least one of the diverting pulleys is on an opposite side of the plane from the wall, and is disposed at a distance from the plane.

19 Claims, 4 Drawing Sheets

ELEVATOR ROPING ARRANGEMENT

Figure 1:
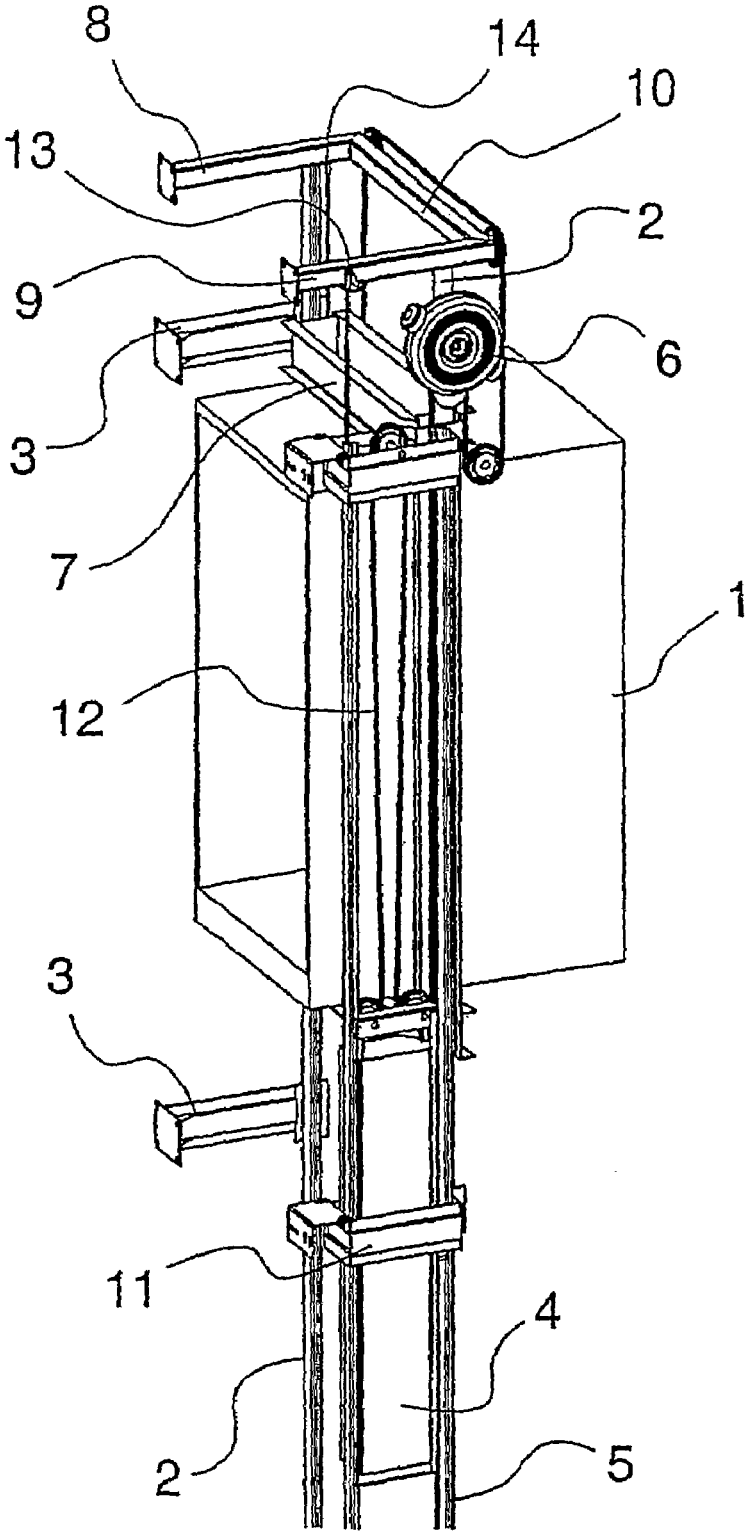

This application is a continuation of PCT/FI2005/000439 filed on Oct. 11, 2005, which is an international application claiming priority from FI 20041473 filed Nov. 16, 2004, the entire contents of which are hereby incorporated by reference.

The present invention relates to an elevator roping arrangement as defined in the preamble of claim 1.

The hoisting ropes of elevators have been made increasingly thinner and stronger in structure, thereby also making it possible to reduce the diameters of traction sheaves and diverting pulleys. One result of this is that it has been possible to implement even greater suspension ratios, for example 3:1 . . . 7:1, and even higher than that. A high suspension ratio correspondingly means that numerous diverting pulleys are needed as an aid to the suspension, and optimizing their placement has been difficult in many solutions. One problem when using a 4:1 suspension, for example, has been passing the hoisting ropes under the elevator car by means of diverting pulleys situated below the elevator car. This solution increases the space below the elevator car, in which case it is difficult to make it possible to drive to the lowest floor in low shafts.

Likewise the so-called rucksack type of suspension used in conventional elevators supported by the front wall of the elevator shaft is problematic because of the great guide rail forces caused by the eccentric suspension. This drawback has limited the operating range of prior-art elevators supported by the front wall to small and essentially slow elevators and only to low-rise buildings.

The object of the elevator roping arrangement of the present invention is to eliminate the above-mentioned drawbacks and to make possible a reliable, simple and easily positionable elevator roping arrangement, especially for elevators without machine room, with a suspension in which the guide rail forces can easily be controlled. A further aim is to achieve a 4:1 elevator suspension, in which the hoisting ropes do not need to pass under the elevator car, thereby making possible a small elevator car in terms of the space required below it. The arrangement of the invention is characterized by what is disclosed in the characterization part of claim 1. Likewise, other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

One advantage of the solution according to the invention is an essentially simple, compact and concentric suspension, as a result of which the guide rail forces are small. Consequently, with the structure of the invention it is possible to reliably and cheaply implement elevators supported by the front wall of the elevator shaft that are larger, more efficient and can travel higher. Another advantage is that the elevator of the invention can more easily be positioned for example on the exterior wall of a building, on the wall of a lobby inside a large building or on the wall of a courtyard. A further advantage is that the space required below the elevator car is small, thus the elevator car can travel close to the bottom of the elevator shaft. This is very advantageous and useful, especially in old buildings when modernizing old elevators. Another advantage also is that installation work is easier and one diverting pulley that until now has been required in prior-art 4:1 suspension can be dispensed with. An advantage of the support element used in the upper part of the shaft is also that the support element can be constructed to protect the hoisting ropes from dirt in the upper end of the elevator shaft. The horizontal section of the hoisting ropes can be made to pass for example wholly or partially inside the support element, in which case dirt cannot attach to them, which could damage the surface of thin hoisting ropes or could cause the rope to jump out of the groove of a diverting pulley with a small diameter.

Figure 2:
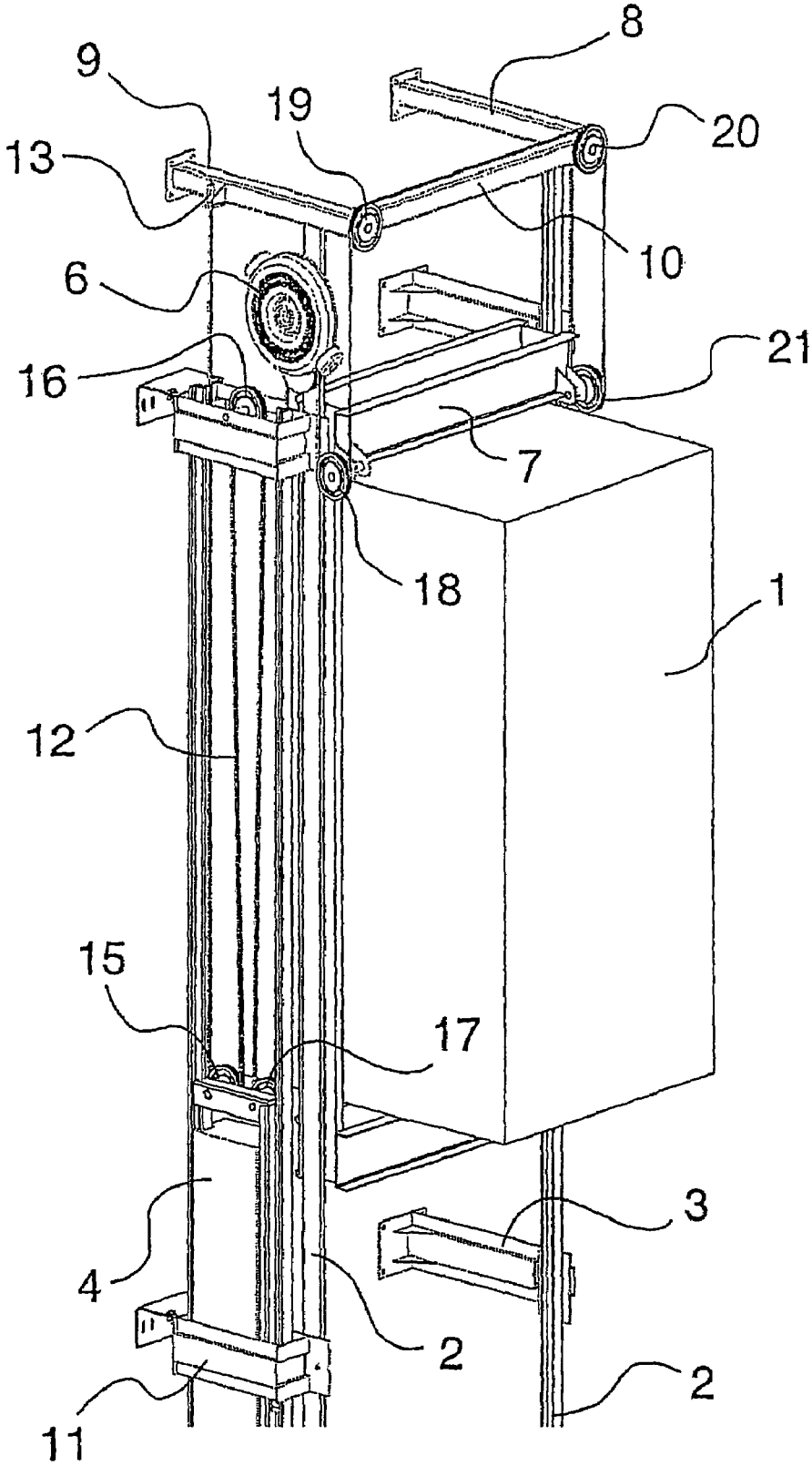
Figure 3:
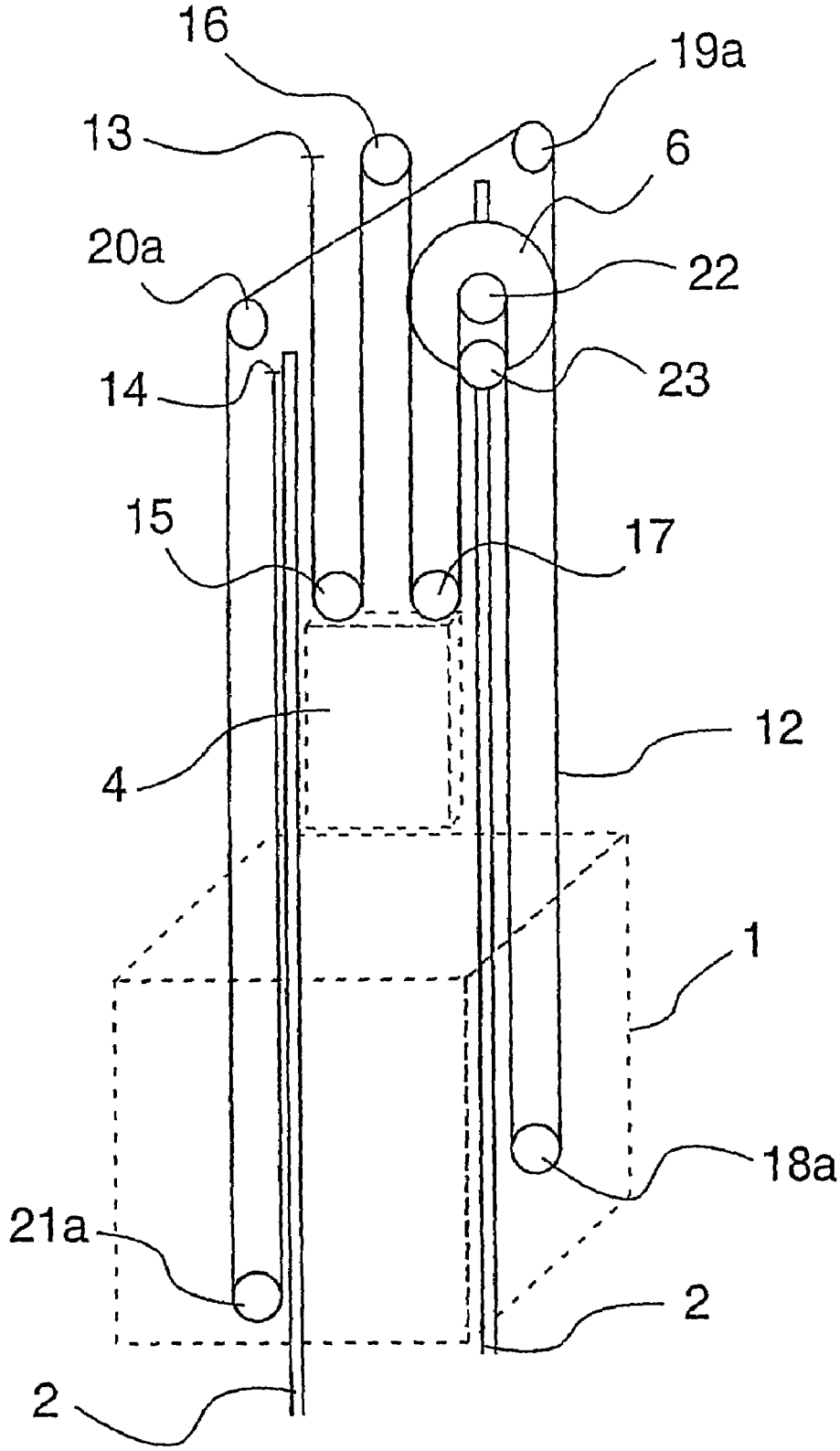
Figure 4:
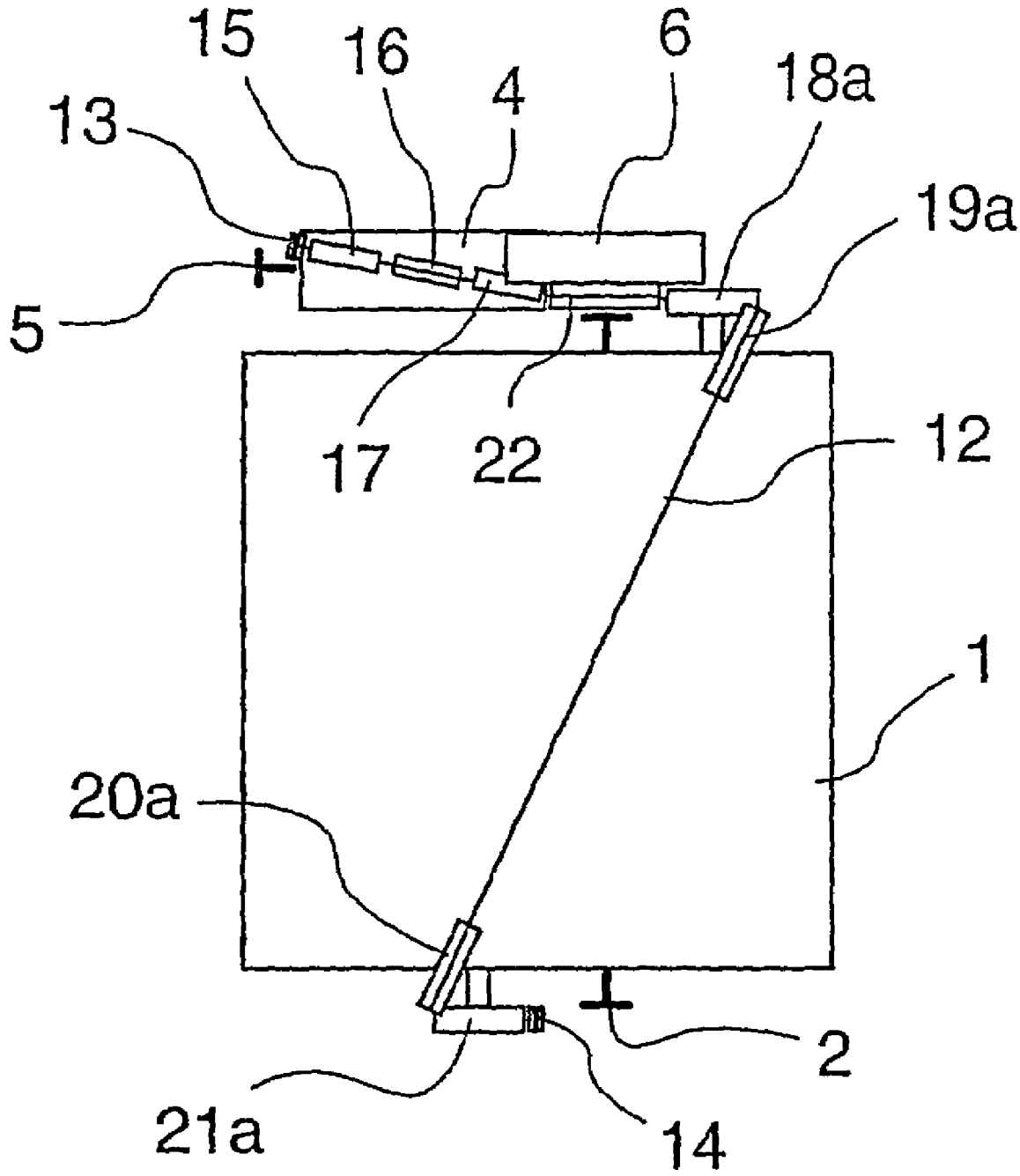

In the following, the invention will be described in detail by the aid of a few examples of its embodiments with reference to the attached drawings, wherein FIG. 1 presents a simplified illustration of one elevator solution applicable to the invention, viewed obliquely from the front and from above, FIG. 2 presents a simplified illustration of one elevator solution according to FIG. 1, viewed obliquely from the rear and from above, FIG. 3 presents a simplified and diagrammatic illustration of another elevator solution applicable to the invention, viewed obliquely from the side and from above, and FIG. 4 presents a simplified top view of the elevator solution presented in FIG. 3.

FIG. 1 presents a general illustration of one traction sheave elevator with counterweight applicable to the invention, wherein the rope arrangement of the invention is presented with an elevator car 1 that is equipped with a car sling 7 being in its upper position. The figure is not drawn to scale nor for example with the correct height proportion, so that the position of the counterweight 4 in relation to the position of the elevator car 1 is not necessarily correct. The elevator is preferably an elevator without machine room, in which the drive machine 6 is situated in the elevator shaft. The elevator presented in FIG. 1 is a traction sheave elevator with machine above and with a counterweight 4, in which the elevator car 1 moves on its path along guide rails 2. The hoisting ropes consist of a number of juxtaposed hoisting ropes 12, which are essentially strong and thin in diameter. In addition, the diverting pulleys used and the traction sheave are essentially small in diameter, thus the preferably gearless drive machine 6 is essentially small in size and light.

In the roping arrangement presented in FIGS. 1 and 2 the elevator is supported via the guide rails 2 by the front wall of the elevator shaft or e.g. in a structure without shaft by the exterior wall of the building or similar on the side of the elevator car 1 containing the door opening. For the sake of clarity, only support by the front wall of the elevator shaft will be described below. The guide rails 2 of the elevator car 1 are supported by the front wall of the shaft by means of guide rail fixings 3 and 11, a sufficient amount of said guide rail fixings being a vertical distance from each other for the full height of the shaft. The guide rail fixing 3 is intended to fasten only the guide rail 2 of the elevator car, while both the guide rails 5 of the counterweight 4 and the second guide rail 2 of the elevator car are fastened with a suitably different guide rail fixing 11.

The upper part of the shaft contains an arrangement for fixing and supporting the elevator machine and some of the diverting pulleys used in the roping arrangement. This fixing and support arrangement is preferably fixed to the top end of the guide rails 2 of the elevator car and comprises e.g. substantially rigid and horizontal support beams 8 and 9, and a substantially rigid support element 10. The support beams 8 and 9 are each fixed to the top end of their own guide rail 2, such that the first end of support beam 8, 9 extends to the front wall of the shaft on the first side of guide rail 2, to which the aforesaid first end is fixed by means of e.g. a bolted joint. Correspondingly, the second end of support beam 8, 9 extends in the horizontal direction for at least some distance to the other side of guide rail 2, which is necessary to achieve essentially concentric suspension.

The drive machine 6 of the elevator is fixed to the top end of the second guide rail 2 of the elevator car preferably on the same side of the elevator car as the counterweight 4 traveling on its guide rails 5.

The fixing and support arrangement preferably consists of a frame, which is fixed at one end to the front wall of the elevator shaft and supported near the other end to the guide rails 2 of the elevator car. The support beams 8 and 9, which are essentially the same length as each other, form the edges of the frame in the depth directions of the elevator cars and the horizontal and beam-like support element 10 connecting the support beams 8, 9 forms the rear edge of the frame. The support element 10 is fixed to the outermost ends of the support beams 8, 9 and at the same time is supported between the top ends of the guide rails 2. Additionally, at least the diverting pulleys 19 and 20 are preferably fixed to the support element 10 at a horizontal distance from the front wall of the elevator shaft that results in a vertical plane between the guide rails 2 of the elevator car being disposed between the diverting pulleys 19 and 20 (on one side of the vertical plane) and the front wall of the elevator shaft (on the other side of the vertical plane). In this way, the support element 10 is fitted to receive the horizontal component caused by rope forces, while the vertical component is essentially supported by the guide rails 2. Because of the support element 10, the fixing and supporting arrangement is very robust and it is possible to direct the rope forces along the optimal route.

The support element 10 also protects the horizontal section of the ropes from becoming dirty e.g. as a structure of U-profile beam, of which one flange is situated above the horizontal section of the ropes.

FIG. 3 presents a suspension solution corresponding to FIGS. 1 and 2, in which the fixing and support system in the upper part of the shaft may deviate from what has been described above. In addition the diverting pulleys 18*a* and 21*a* on the elevator car are disposed on the side walls of the elevator car without a car sling 7. The actual passage of the ropes over the diverting pulleys and the traction sheave fully corresponds to the solution according to FIGS. 1 and 2. The suspension solution according to FIG. 3 is described in more detail in conjunction with FIG. 4.

The passage of the elevator hoisting ropes in FIGS. 1, 2, and 3 is as follows: one end of the hoisting ropes 12 is fastened to the anchored fixing point 13 in the upper part of the shaft, from which fixing point 13 the hoisting ropes 12 descend to the diverting pulley 15 fitted into position on the counterweight 4. After having passed under diverting pulley 15, the hoisting ropes 12 continue upward to the diverting pulley 16, which is fitted into position in the upper part of the elevator shaft. After passing around the top of the diverting pulley 16, the hoisting ropes 12 return downward to the diverting pulley 17 fitted into position on the counterweight 4. After passing around the bottom of the diverting pulley 17, the hoisting ropes 12 continue upward to the traction sheave 22 of the drive machine 6 fitted into position in the upper part of the elevator shaft, touching the diverting pulley 23 that is preferably positioned in the proximity of the drive machine 6 and/or in contact with the bottom part of the traction sheave 22.

Between the diverting pulley 23 and the traction sheave 22 is DW (Double Wrap) roping as presented in FIG. 3, in which roping the hoisting ropes 12 pass upwards, touching the diverting pulley 23 to the traction sheave 22. Having passed around the traction sheave 22, hoisting ropes 12 return to the diverting pulley 23. After passing around the diverting pulley 23, the hoisting ropes 12 return back to the traction sheave 22. Since the diverting pulley 23 is essentially the same size as the traction sheave 22 in the Double Wrap roping, the diverting pulley 23 can also act as a damper pulley. In such a case, the hoisting ropes 12 going from the traction sheave 22 to the elevator car 1 travels via the rope grooves of the diverting pulley 23, and bending of the hoisting ropes 12 caused by the diverting pulley is very minimal. It could be said that the hoisting ropes 12 from the traction sheave 22 going to and coming from the elevator car 1 only "touch" the diverting pulley 23. This kind of "touching" serves as a solution for damping vibration of the outbound hoisting ropes 12 and is also applicable in other roping solutions.

Other examples of roping solutions include Single Wrap (SW) roping, in which the diverting pulley is substantially the same size as the traction sheave of the drive machine, and in which use of a diverting pulley is applied as the "touching pulley" described above. In the SW roping of the example the ropes pass around the traction sheave only once, in which case the contact angle between the rope and the traction sheave is approximately 180°. In this case the diverting pulley is used only as an aid for the "touching" of the rope in the manner described above, so that the diverting pulley functions as a rope guide and as a damping pulley for damping vibrations.

The ropes continue their passage from the traction sheave 22 downwards touching the diverting pulley 23 to the diverting pulley 18/18*a*, which is fitted into position preferably on the elevator car 1; either on the car sling 7, as is diverting pulley 18, or on the first side wall of the elevator car, as is diverting pulley 18*a*. After passing around the bottom of the diverting pulley 18/18*a*, the ropes 12 continue upwards to the diverting pulley 19/19*a* fitted into position in the upper part of the elevator shaft, and after passing around the top of diverting pulley 19/19*a* the ropes continue in a substantially horizontal direction to the other diverting pulley 20/20*a* fitted into position in the upper part of the elevator shaft, said diverting pulley 20/20*a* being at essentially the same height as the diverting pulley 19/19*a*, but substantially symmetrically on the other side of the elevator car as viewed from above.

After passing around the top of the diverting pulley 20/20*a* the ropes continue their passage downwards to the diverting pulley 21/21*a*, which is preferably fitted into position on the elevator car 1; either on the car sling as is diverting pulley 21, or to the second side wall of the elevator car, as is diverting pulley 21*a*. After passing around the bottom of the diverting pulley 21/21*a* the ropes 12 continue upwards to the anchored fixing point 14 in the upper part of the elevator shaft, to which the other end of the elevator ropes 12 is fastened.

FIG. 4 presents a top view of the roping arrangement presented in FIG. 3. The biggest difference to the roping arrangement according to FIGS. 1 and 2 is that the diverting pulleys 18*a* and 21*a* as well as 19*a* and 20*a* are not situated as far away from the front wall of the elevator shaft as each other, rather the criterion has been equidistant positioning in relation to the guide rail line of the guide rails 2 of the elevator car 1 as viewed from the top. Likewise, the elevator itself is not necessarily supported by the front wall of the elevator shaft. Instead in the solution according to FIGS. 3 and 4 it is possible to use a support element receiving the horizontal component of the rope forces that corresponds to the support element 10, which if viewed from above would be in a diagonal position with respect to the guide rail line.

It is obvious to the person skilled in the art that different embodiments of the invention are not limited to the example described above, but that they may be varied within the scope of the claims presented below. Thus, for instance, the drive machine 6 and the traction sheave 22 of the elevator and/or the diverting pulleys 16, 19/19*a*, and 20/20*a* situated in the upper part of the elevator shaft can be fixed into position on the frame structure formed by the guide rails 2, on the beam structure situated in the upper part of the elevator shaft, individually onto the elevator shaft, or to some other fixing arrangement suited for the purpose. Likewise, the diverting pulleys 18/18*a* and 21/21*a* on the elevator car 1 can be fixed into position on the frame structure of the elevator car 1, on a beam structure or beam structures on the elevator car 1, individually on the elevator car 1, or on some other fixing arrangement suited for the purpose.

It is further obvious to the person skilled in the art that although, for example, there is a counterweight in the suspension described, the invention or preferred embodiments of it can just as well be used in traction sheave elevators without counterweight, as well as with other suspension ratios and in other types of suspensions than that described in the example.

It is also obvious to the person skilled in the art that the use of the diverting pulley 23 described above is not significant with respect to the invention, so that diverting pulley 23 may also be dispensed with.

The invention claimed is:

1. A roping arrangement for an elevator that comprises an elevator car, two elevator car guide rails, and a drive machine, the roping arrangement comprising:

hoisting ropes;

first, second, third, and fourth diverting pulleys; and a fixing and support arrangement;

wherein the hoisting ropes move the elevator car along the elevator car guide rails, wherein the first diverting pulley is disposed on the elevator car, wherein the second and third diverting pulleys are disposed in an upper part of an elevator shaft or equivalent, wherein the fourth diverting pulley is disposed on the elevator car, wherein the hoisting ropes are disposed to pass from a traction sheave of the drive machine to the first diverting pulley, wherein the hoisting ropes are further disposed to pass from the first diverting pulley, via the second and third diverting pulleys, to the fourth diverting pulley, wherein the fixing and support arrangement is disposed at a top end of the elevator car guide rails, wherein the fixing and support arrangement comprises:

two support beams;

wherein the support beams are of essentially a same length, wherein each of the support beams is fixed at a first end of a respective support beam to a wall of the elevator shaft or equivalent, wherein each of the support beams extends from the first end of the respective support beam to a second end of the respective support beam away from the wall of the elevator shaft or equivalent, wherein each of the support beams is fixed to a respective elevator car guide rail between the first and second ends of the respective support beam, wherein a vertical plane is defined between the elevator car guide rails, wherein at least one of the first, second, third, and fourth diverting pulleys is on an opposite side of the vertical plane from the wall of the elevator shaft or equivalent, and wherein the at least one of the first, second, third, and fourth diverting pulleys is disposed at a distance from the vertical plane.

2. The roping arrangement of claim 1, wherein each of the support beams is fixed to the respective elevator car guide rail between the first and second ends of the respective support beam so that a total force supported by the elevator car guide rails acts in the vertical plane.

3. The roping arrangement of claim 1, wherein the fixing and support arrangement further comprises:

a substantially rigid support element;

wherein the support beams are connected together using the substantially rigid support element.

4. The roping arrangement of claim 1, wherein the elevator further comprises:

a car sling attached to the elevator car;

wherein the first and fourth diverting pulleys are disposed on the elevator car by attaching the first and fourth diverting pulleys to the car sling.

5. The roping arrangement of claim 1, wherein the second diverting pulley is disposed on a same side of the vertical plane as the third diverting pulley.

6. The roping arrangement of claim 1, wherein the second diverting pulley is disposed on an opposite side of the vertical plane from the third diverting pulley.

7. The roping arrangement of claim 1, wherein the first and second diverting pulleys are disposed on the opposite side of the vertical plane from the wall of the elevator shaft or equivalent.

8. The roping arrangement of claim 1, wherein the second and third diverting pulleys are disposed on the opposite side of the vertical plane from the wall of the elevator shaft or equivalent.

9. The roping arrangement of claim 1, wherein the third and fourth diverting pulleys are disposed on the opposite side of the vertical plane from the wall of the elevator shaft or equivalent.

10. The roping arrangement of claim 1, wherein the first, second, third, and fourth diverting pulleys are disposed on the opposite side of the vertical plane from the wall of the elevator shaft or equivalent.

11. The roping arrangement of claim 1, wherein the hoisting ropes are further disposed to pass from the fourth diverting pulley to a fixing point.

12. The roping arrangement of claim 1, wherein the drive machine is disposed on a first side of the elevator next to a second side of the elevator, and wherein the second side of the elevator is adjacent to the wall of the elevator shaft or equivalent.

13. The roping arrangement of claim 1, wherein the elevator further comprises:

a counterweight.

14. The roping arrangement of claim 1, wherein the wall of the elevator shaft or equivalent comprises an interior or exterior wall of a building.

15. The roping arrangement of claim 3, wherein the second and third diverting pulleys are disposed on the substantially rigid support element.

16. The roping arrangement of claim 4, wherein the car sling is attached to an upper part of the elevator car.

17. The roping arrangement of claim 13, wherein the counterweight is disposed on a first side of the elevator next to a second side of the elevator, and wherein the second side of the elevator is adjacent to the wall of the elevator shaft or euivalent.

18. The roping arrangement of claim 13, wherein the counterweight is on a same side of the elevator as the drive machine.

19. The roping arrangement of claim 13, further comprising:

fifth, sixth, and seventh diverting pulleys;

wherein the fifth and seventh diverting pulleys are disposed on the counterweight, wherein the sixth diverting pulley is disposed in the upper part of the elevator shaft or equivalent, wherein the hoisting ropes are further disposed to pass from a fixing point to the fifth diverting pulley, wherein the hoisting ropes are further disposed to pass from the fifth diverting pulley to the sixth diverting pulley, wherein the hoisting ropes are further disposed to pass from the sixth diverting pulley to the seventh diverting pulley, and wherein the hoisting ropes are further disposed to pass from the seventh diverting pulley to the traction sheave of the drive machine.

* * * * *